US006250477B1

(12) United States Patent
Swanink

(10) Patent No.: US 6,250,477 B1
(45) Date of Patent: Jun. 26, 2001

(54) STARSCREEN

(75) Inventor: Gererdus Cornelis Petrus Maria Swanink, Coevorden (NL)

(73) Assignee: Machinefabriek Lubo B.V. (NL)

( * ) Notice: Subject to any disclaimer, the term of this patent is extended or adjusted under 35 U.S.C. 154(b) by 0 days.

(21) Appl. No.: 09/220,542

(22) Filed: Dec. 23, 1998

(30) Foreign Application Priority Data

Dec. 24, 1997 (NL) ..... 1007910

(51) Int. Cl.[7] ..... B07B 1/52
(52) U.S. Cl. ..... 209/386; 209/390; 209/672
(58) Field of Search ..... 209/320, 324, 209/379, 385, 386, 388, 389, 390, 667, 671, 672

(56) References Cited

U.S. PATENT DOCUMENTS

| | | | | |
|---|---|---|---|---|
| 3,316,977 | * | 5/1967 | Snook | 209/386 X |
| 4,266,676 | * | 5/1981 | Ruckstuhl et al. | 209/672 |
| 5,480,034 | * | 1/1996 | Kobayashi | 209/672 X |

FOREIGN PATENT DOCUMENTS

| | | | | |
|---|---|---|---|---|
| 2751562 | | 5/1979 | (DE) . | |
| 3926451 | * | 3/1991 | (DE) | 209/672 |
| 1240250 | | 10/1959 | (FR) . | |
| 2313284A | | 11/1997 | (GB) . | |
| 9002165 | | 5/1992 | (NL) . | |
| 578920 | * | 11/1977 | (SU) | 209/672 |
| 1428237 | * | 10/1988 | (SU) | 209/672 |

* cited by examiner

*Primary Examiner*—Tuan N. Nguyen
(74) *Attorney, Agent, or Firm*—Howard & Howard

(57) ABSTRACT

The invention relates to a star scalper for separating supplied material, and has a number of parallel, rotatable shafts that are each equipped with a number of star bodies placed at a distance from each other, which bodies have a hub and radially protruding star fingers, in which the star bodies of each shaft extend between the star bodies of the adjacent shaft. According to the invention at least one star body is provided with a scraper, which scraper reaches to the hub of the adjacent star body.

11 Claims, 2 Drawing Sheets

STARSCREEN

BACKGROUND OF THE INVENTION

The invention relates to a star scalper for separating supplied material, comprising a number of parallel, rotatable shafts that are each equipped with a number of star bodies placed at a distance from each other, which bodies have a hub and radially protruding star fingers, in which the star bodies of each shaft extend between the star bodies of the adjacent shaft.

Such a scalper is known and for instance meant for sifting waste, in which the waste has to be separated in a crude and fine fraction. There is a certain distance between the extremities of the fingers of the one star body on one shaft and the hub of the star wheels in between which the one star body has to rotate on the adjacent shaft, which distance together with the intermediate distance between two consecutive star bodies on the adjacent shaft determine a rectangular passage. Said rectangular passage is normative for the size of the objects which are let through by the star scalper. The star fingers of the star scalper move along each other with small intermediate distance. Usually the shafts of the star scalper all rotate in the same direction, so that the material moves over the scalper and the fraction which is left on the scalper is discharged. In this way it is also effected that an object which is too large for the passage will not block the passage, because in every passage a star body is present which makes an upward movement, so that the object is released.

A disadvantage of the known star scalper is that fine material into the fine fraction may cake onto the hubs of the star bodies, as a result of which the effective passage is made narrower. In this way the sifting effect of the star scalper is reduced after some time. The star scalper also has to be cleansed regularly.

It is an object of the invention to provide an improved star scalper.

SUMMARY OF THE INVENTION

This object is achieved according to the invention with a star scalper of the kind mentioned in the preamble, in which at least one star body is provided with a scraper, which scraper reaches to the hub of the adjacent star body.

In this way it is effected that at each revolution of the star body with the scraper, the hub of the adjacent star body is at least partly cleansed, as a result of which caking of dirt and silting up of the passage is prevented. Because there is less pollution, less engine power is necessary during sifting, the star scalper has to be cleansed less often and the sifting fraction remains more regular.

Preferably the scraper is arranged near the extremity of a star finger of the star body. In this way the scraper can remain small.

According to a preferred embodiment the scraper is at least as wide as the thickness of the star finger. In this way a large part of the adjacent hub is cleansed.

Preferably on one side of the star body the scraper continues until the star fingers of the adjacent star body. In this way these star fingers are at least partly cleansed as well.

According to a preferred embodiment each star body is provided with a scraper, in which way all hubs are kept clean.

Preferably all star bodies with scraper are identical, so that the star bodies can be economically manufactured.

Preferably per rotatable shaft the scrapers of the star bodies are placed in a jumped manner, so that the scrapers on one shaft do not scrape all at a time along the hubs of the adjacent shaft. In this way the load of the shaft is more regular.

According to a preferred embodiment the star fingers of the star body are flexible in axial direction. In this way the star fingers will not break off but be able to deflect when a hard object such as for instance a stone gets stuck in a slit between two consecutive star bodies.

Preferably shafts that are adjacent to each other are always rotatable with a different number of revolutions, as a result of which the entire circumference of the hub is kept clean by the scraper.

The invention also relates to a star body for a star scalper, comprising a hub with an aperture for attachment on a shaft of the star scalper and a number of radially protruding star fingers, in which at least one scraper is arranged to scrape along the hub of a star body on an adjacent shaft of the star scalper.

According to a preferred embodiment of the star body the scraper is arranged near the extremity of a star finger, and preferably the fingers of the star body are flexible in axial direction.

The invention will now be elucidated on the basis of a preferred embodiment, referring to the drawing.

DETAILED DESCRIPTION OF THE INVENTION

Figure 1:
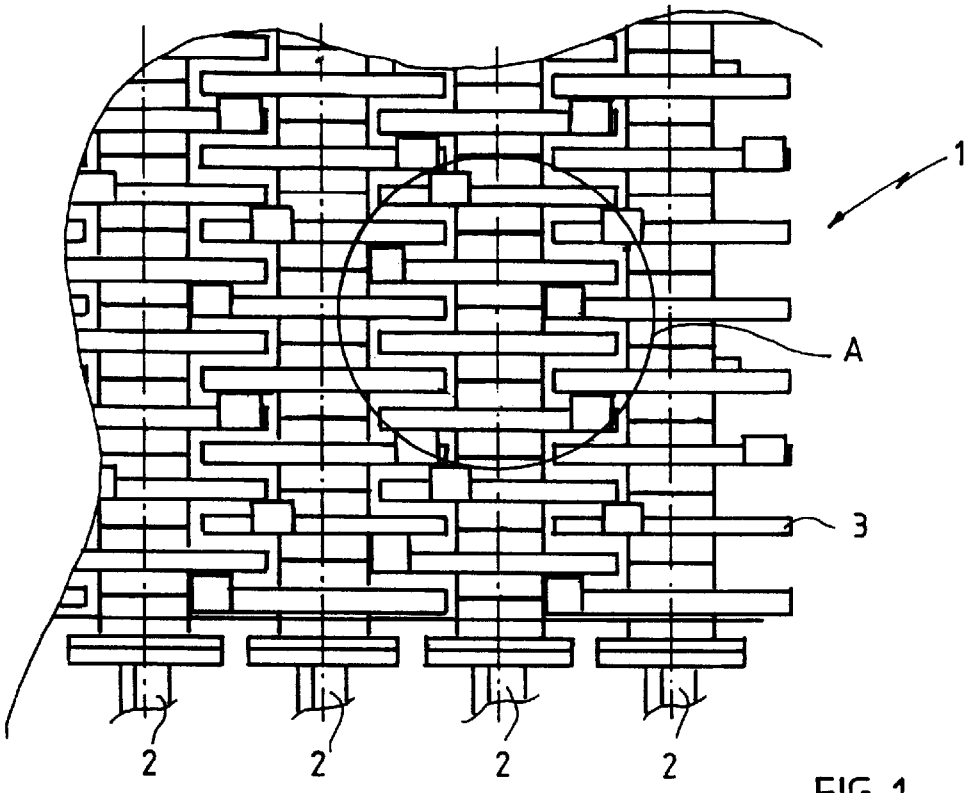
FIG. 1 schematically shows a part of the star scalper according to the invention in top view.

FIG. 1 shows the top view of a part of a star scalper 1 with parallel shafts 2 arranged at equal distances and on each shaft 2 a great number of star bodies 3. A part A of FIG. 1 is shown on a larger scale in FIG. 2.

Figure 2:
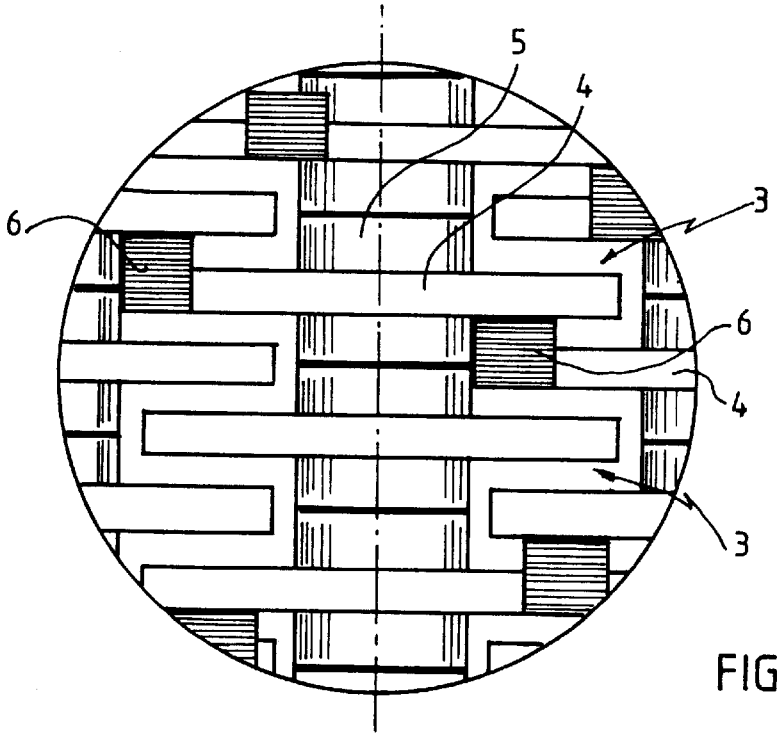
FIG. 2 shows a part A of the star scalper according to FIG. 1 on a larger scale.

FIG. 2 shows some star bodies 3 which each consist of a hub 5 with a number of star fingers 4 which are not shown separately. On one of the star fingers 4 of each star body 3 a scraper 6 has been arranged.

Figure 3:
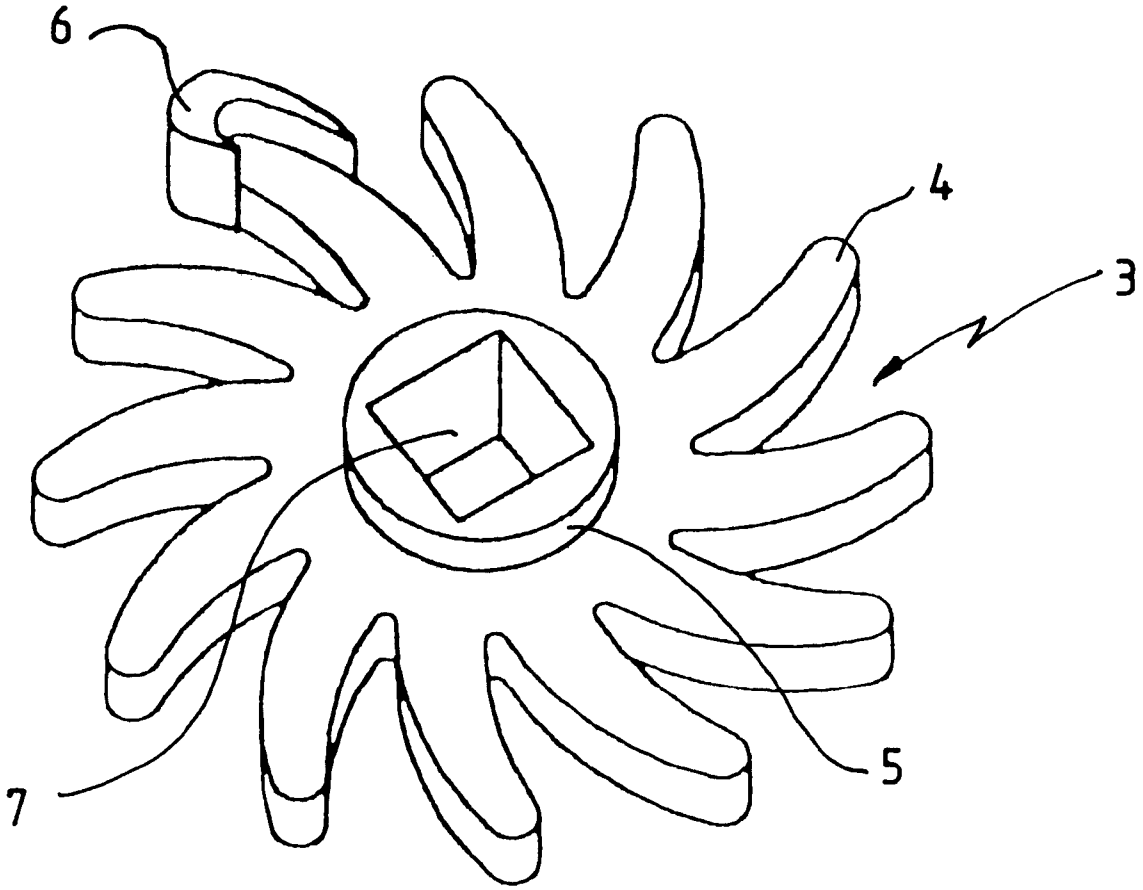
FIG. 3 shows a single star body of the star scalper according to FIG. 1 on a larger scale.

FIG. 3 shows a view in perspective of one star body 3 with a hub 5, a number of star fingers 4, and a scraper 6. In the hub 5 a square hole 7 has been arranged in order to be able to arrange the star wheel 3 locked against rotation on a square shaft 2.

As is shown in FIGS. 2 and 3 the scraper 6 protrudes radially and to one side axially. The scraper 6 can only protrude axially to one side, in order not to collide with the scraper on the adjacent star body.

When using the star scalper 1 the scraper 6 will always scrape the hubs of the star bodies on the adjacent shaft, so that no material can attach itself there. The scraper 6 scrapes along the major part of the width of the hubs of the star bodies in between which the scraper 6 moves, and the scraper 6 also scrapes along one side of the fingers 4 of adjacent star body. Thus the major part of the passage between the hubs and the star fingers is kept free, and because the shafts 2 of the star scalper 1 rotate at mutual different speeds, the entire circumference of the hubs 5 is kept clean by the scraper 6.

By arranging the star bodies 3 on one shaft 2, as seen in relation to the scraper 6, turned one to the other a quarter of a turn around the shaft 2, a quarter of the number of scrapers 6 at a time will scrape along the hubs of the star bodies of the adjacent shaft 2, as a result of which the load of the driving of the shafts 2 is more even.

With the star scalper according to the invention all star bodies 3 with a scraper 6 are identical, as a result of which the costs of manufacturing of a star body 3 with scraper 6 are not significantly higher than the costs of manufacturing a star body 3 without scraper.

Preferably the star fingers 4 of the star body 3 are flexible in axial direction, as a result of which the star fingers 4 will not break off but will deflect when for instance a hard object gets stuck in the intermediate space between two star bodies 3 moving along each other.

It is possible to place a close fitting steel bush over two hubs 5 that are mentioned to each other. It will be understood that the scrapers will then be active on the surface of the bush.

What is claimed is:

1. A star body for a star scalper with a plurality of adjacent shafts, comprising:

a hub having a plurality of radially protruding star fingers and an aperture for securing said star body on a shaft of the star scalper;

at least one of said star fingers having a scraper attached near the extremity of one of said star fingers of said star body and arranged to scrape along a hub of a star body on an adjacent shaft of the star scalper, said star fingers being flexible in an axial direction.

2. A star scalper for separating supplied material comprising:

a plurality of parallel, rotatable shafts including a first shaft positioned adjacent to a second shaft, each of said shafts having a plurality of spaced apart adjacent star bodies;

cach of said star bodies having a hub and a plurality of radially protruding star fingers, said star bodies of said first shaft extending between said star bodies of said second shaft, and said star bodies of said second shaft extending between said star bodies of said first shaft in an alternating arrangement such that the space between adjacent star bodies on each of said first and said second shafts receives a star body of the other of said first and said second shafts; and each of said star bodies on said first and said second shaft including at least one scraper, said scraper attached near the extremity of one of said star fingers of said star body and extending to said hub of one of said star bodies on the other of said first or said second shaft.

3. A star scalper according to claim 2, wherein said scraper is at least as wide as the thickness of one of said star fingers.

4. A star scalper according to claim 3, wherein on one side of said star body having said scraper, said scraper extends to said star fingers of said star body on the other of said first or said second shafts.

5. A star scalper according to claim 2, wherein each of said adjacent star bodies on each of said shafts includes a scraper.

6. A star scalper according to claim 5, wherein all of said star bodies with said scraper are identical.

7. A star scalper according to claim 5, wherein on each of said shafts said scrapers of said adjacent star bodies are off set from each other.

8. A star scalper according to claim 2, wherein said star fingers of said star body are flexible in an axial direction.

9. A star scalper according to claim 2 wherein said first shaft is rotated at a different speed than said second shaft.

10. A star scalper for separating supplied material comprising:

a plurality of parallel, rotatable shafts including a first shaft positioned adjacent to a second shaft, each of said shafts having a plurality of spaced apart adjacent star bodies;

each of said star bodies having a hub and a plurality of radially protruding star fingers, said star bodies of said first shaft extending between said star bodies of said second shaft, and said star bodies of said second shaft extending between said star bodies of said first shaft in an alternating arrangement such that the space between adjacent star bodies on each of said first and said second shafts receives a star body of the other of said first and said second shafts; and each of said star bodies on said first and said second shaft including at least one scraper, said scraper attached near the outer extremity of one of said star fingers of said star body and extending axially to said hub of one of said star bodies on the other of said first or said second shaft.

11. A star scalper for separating supplied material comprising:

a plurality of parallel, rotatable shafts including a first shaft positioned adjacent to a second shaft, each of said shafts having a plurality of spaced apart adjacent star bodies;

each of said star bodies having a hub and a plurality of radially protruding star fingers, said star bodies of said first shaft extending between said star bodies of said second shaft, and said star bodies of said second shaft extending between said star bodies of said first shaft in an alternating arrangement such that the space between adjacent star bodies on each of said first and said second shafts receives a star body of the other of said first and said second shafts; and each of said star bodies on said first and said second shaft including at least one scraper, said scraper attached near the outer extremity of one of said star fingers of said star body and extending radially outward and axially sideways from said star finger to a location closely adjacent said lub of said star bodies on the other of said first or said second shaft.

* * * * *

UNITED STATES PATENT AND TRADEMARK OFFICE

CERTIFICATE OF CORRECTION

PATENT NO. : 6,250,477 B1
DATED : June 26, 2001
INVENTOR(S) : Gererdus Cornelis Petrus Maria Swanink It is certified that error appears in the above-identified patent and that said Letters Patent is hereby corrected as shown below:

Column 4, claim 11,
Line 54, change "lub of" to -- hub of one of --.

Signed and Sealed this

Twenty-sixth Day of March, 2002

*Attest:*

*Attesting Officer*

JAMES E. ROGAN
*Director of the United States Patent and Trademark Office*